US011142388B2

(12) United States Patent
Dong

(10) Patent No.: US 11,142,388 B2
(45) Date of Patent: Oct. 12, 2021

(54) THERMAL CONTAINER

(71) Applicant: XIAMEN KINGQUEEN INDUSTRIAL CO., LTD., Fujian (CN)

(72) Inventor: Jinfei Dong, Xiamen (CN)

(73) Assignee: XIAMEN KINGQUEEN INDUSTRIAL CO., LTD., Fujian (CN)

( * ) Notice: Subject to any disclaimer, the term of this patent is extended or adjusted under 35 U.S.C. 154(b) by 211 days.

(21) Appl. No.: 16/264,633

(22) Filed: Jan. 31, 2019

(65) Prior Publication Data

US 2020/0172320 A1 Jun. 4, 2020

(30) Foreign Application Priority Data

Dec. 4, 2018 (CN) ..... 201822027084.4

(51) Int. Cl.
*B65D 81/38* (2006.01)
*A45C 11/20* (2006.01)
*B65D 25/28* (2006.01)

(52) U.S. Cl.
CPC ..... *B65D 81/3816* (2013.01); *A45C 11/20* (2013.01); *B65D 25/2841* (2013.01); *B65D 81/3823* (2013.01)

(58) Field of Classification Search
CPC ... B65D 81/3897; B65D 81/3823; F25D 3/08; A45C 11/20
See application file for complete search history.

(56) References Cited

U.S. PATENT DOCUMENTS 1,006,135 A * 10/1911 Schleicher ..... A47J 39/00 220/592.22
1,895,278 A * 1/1933 Crawford ..... B65D 81/3886 383/96
1,949,677 A * 3/1934 Crawford ..... B65D 81/3886 383/96
3,810,367 A * 5/1974 Peterson ..... F25D 3/00 435/1.1
3,872,905 A * 3/1975 Gaiser ..... B65D 81/00 383/96
4,162,029 A * 7/1979 Gottsegen ..... A47J 41/0072 220/23.83
4,375,828 A * 3/1983 Biddison ..... A45C 11/20 206/523

(Continued)

FOREIGN PATENT DOCUMENTS

WO WO-0218210 A1 * 3/2002 ..... A01N 1/0273

*Primary Examiner* — Mollie Impink
(74) *Attorney, Agent, or Firm* — Leong C. Lei

(57) ABSTRACT

A thermal container includes a cover and a main body. The cover is opened and closed relative to the main body through an opening-closing assembly. The cover is formed with a sealing protrusion extending toward the main body. The main body is formed with an annular retaining wall extending from an upper portion of an inner wall of the main body. A sealing ring is provided at the mating portion between the cover and the main body. The thermal container realizes the sealing through the sealing protrusion and the retaining wall, and the sealing ring is provided to further enhance the airtightness, preventing the gas or liquid from leaking out from the gap of the opening-opening assembly, and improving the thermal insulation performance of the container.

9 Claims, 9 Drawing Sheets

(56) References Cited

U.S. PATENT DOCUMENTS

| | | | | | |
|---|---|---|---|---|---|
| 4,566,292 | A * | 1/1986 | Parmet | F25D 3/08 | 215/286 |
| 5,295,365 | A * | 3/1994 | Redford | F25D 3/08 | 62/265 |
| D351,533 | S * | 10/1994 | Lynam, Jr. | D7/605 | |
| 5,582,314 | A * | 12/1996 | Quinn | B65D 47/0885 | 215/237 |
| 10,314,377 | B2 * | 6/2019 | Stephens | A45C 13/005 | |
| 10,384,855 | B2 * | 8/2019 | Seiders | A45C 3/00 | |
| 10,712,070 | B1 * | 7/2020 | Touchton | F25D 21/14 | |
| 2007/0157635 | A1 * | 7/2007 | Ford | F25D 3/08 | 62/62 |
| 2018/0141718 | A1 * | 5/2018 | Ahlstrom | B65D 25/2841 | |

* cited by examiner

THERMAL CONTAINER

BACKGROUND OF THE INVENTION

1. Field of the Invention

The present invention relates to a storage container, and more particularly to a thermal container.

2. Description of the Prior Art

Thermal containers are containers having thermal insulation properties. In our daily life, thermal box are widely used, especially in the fields of take-away, medicine, scientific research, etc. for carrying articles that need to be kept in a constant temperature environment. Compared with a general storage box, the main body of a thermal box is made of special materials to attain a thermal function, so that the main body has a short-term thermal effect for storing food, medicines, samples, and the like and for maintaining the temperature and freshness of the above items.

There are many kinds of opening-closing structures for thermal boxes/bags, such as buckle, a Velcro tape, a zipper and the like, so that the cover and the main body of a thermal box/bag can be opened and closed. No matter what kind of opening-closing structures, the joint between the cover and the main body may have a gap, and the sealing property is poor, resulting in air leakage or liquid leakage to deteriorate the thermal insulation performance.

Accordingly, the inventor of the present invention has devoted himself based on his many years of practical experiences to solve these problems.

SUMMARY OF THE INVENTION

The primary object of the present invention is to provide a thermal container which has a simple structure, good sealing performance, and prevents air leakage or liquid leakage, thereby improving thermal insulation performance.

In order to achieve the above object, the present invention adopts the following technical solutions.

A thermal container comprises a cover and a main body. The main body is formed with a storage space. The cover is movably connected to an opening of the main body. The cover is opened and closed relative to the main body through an opening-closing assembly. The opening-closing assembly includes an upper connecting member and a lower connecting member that cooperate with each other. The upper connecting member is connected to the cover. The lower connecting member is connected to the main body. The cover is formed with a sealing protrusion that is located at an inner side of the upper connecting member and extends toward the main body. The main body is formed with an annular retaining wall extending from an upper portion of an inner wall of the main body. The sealing protrusion is movably fitted to the retaining wall. A sealing ring is provided at a mating portion between the cover and the main body. The sealing ring is fixed to one of the cover and the main body. The sealing ring is movably abutted against one of the retaining wall and the sealing protrusion.

Preferably, the sealing ring is disposed between a side surface of the sealing protrusion and a top surface of the retaining wall.

Alternatively, the sealing ring is disposed between a side surface of the sealing protrusion and a side surface of the retaining wall.

Alternatively, the sealing ring is disposed between an underside of the sealing protrusion and a top surface of the retaining wall.

Alternatively, the sealing ring is disposed between an underside of the sealing protrusion and a side surface of the retaining wall.

Preferably, the cover and the main body are made of fabrics. An upper shaping board is interlaid between the sealing protrusion and the cover. The retaining wall extends downward to a bottom of the main body. A side shaping board is interlaid between the retaining wall and the main body.

Preferably, the fabrics are made of a composite material of a polyvinyl chloride (PVC), thermoplastic polyurethane (TPU), ethylene-vinyl acetate (EVA) or poly ethylene-vinyl acetate (PEVA) material and a textile material.

Preferably, the upper shaping board and the side shaping board are made of PE cotton, ethylene-vinyl acetate (EVA), thermoplastic rubber (TPR) or nitrile butadiene rubber (NBR).

Preferably, a support board is provided at a mating portion between the sealing ring and the cover or/and the main body.

Preferably, the support board is made of a plastic material.

Preferably, the support board is fixed to a surface of an inner layer fabric of the main body or/and the cover.

Preferably, the support board is interlaid between an inner layer fabric and an outer layer fabric of the main body or/and the cover.

Preferably, the sealing ring is made of polyvinyl chloride (PVC), thermoplastic polyurethane (TPU), thermoplastic rubber (TPR), rubber or silicone.

Preferably, the opening-closing assembly is a zipper.

By adopting the above structure, when the cover is fastened to the main body through the opening-closing assembly, the sealing protrusion covers the inner surface of the retaining wall to seal the cover and the main body. The sealing ring is pressed to block the gap between the sealing protrusion and the retaining wall, thereby increasing the airtightness between the sealing protrusion and the retaining wall to prevent air leakage or liquid leakage from the gap of the opening-closing assembly. The thermal insulation property of the thermal container is improved.

DETAILED DESCRIPTION OF THE PREFERRED EMBODIMENTS

Figure 1:
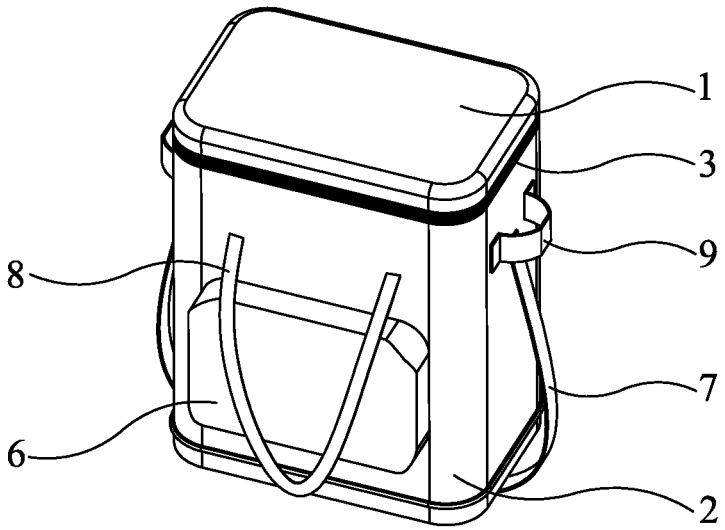
FIG. 1 is a perspective view of a preferred embodiment of the present invention in a closed state.
Figure 2:
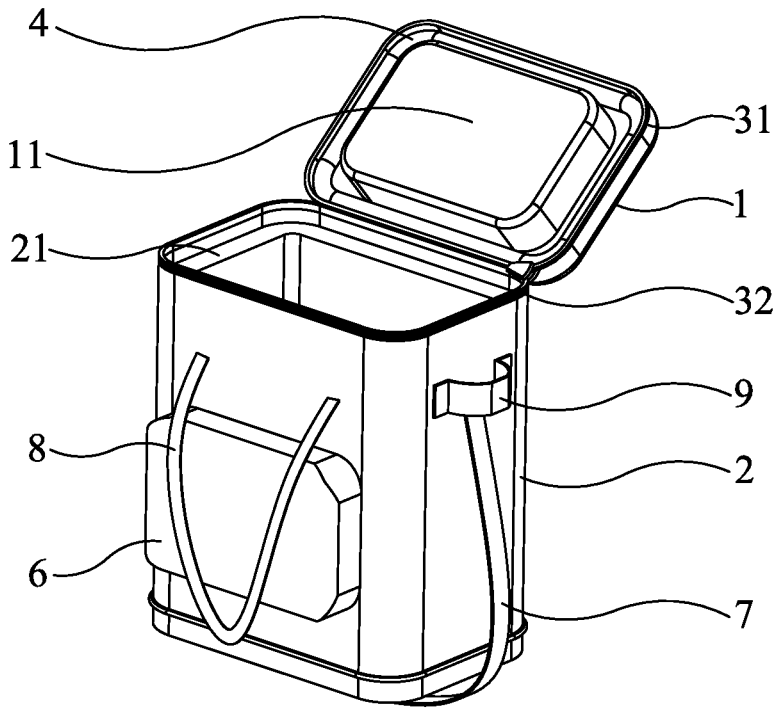
FIG. 2 is a perspective view of the preferred embodiment of the present invention in an open state.
Figure 3:
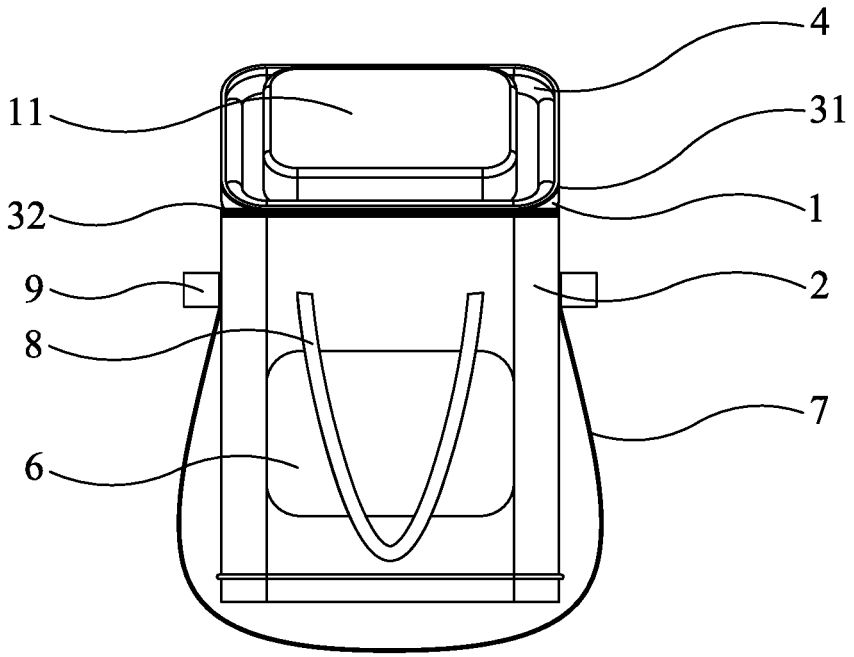
FIG. 3 is a front view of the preferred embodiment of the present invention in an open state.
Figure 4:
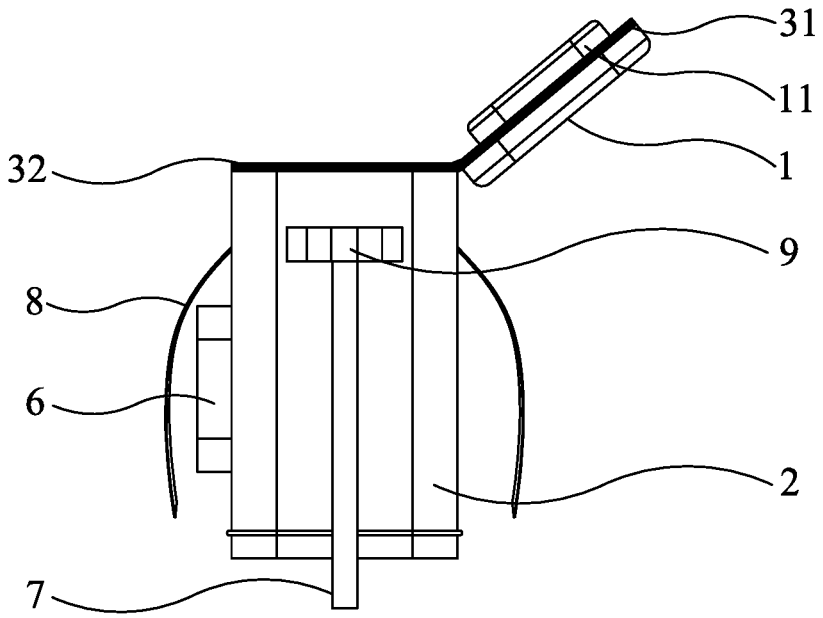
FIG. 4 is a side view of the preferred embodiment of the present invention in an open state.
Figure 5:
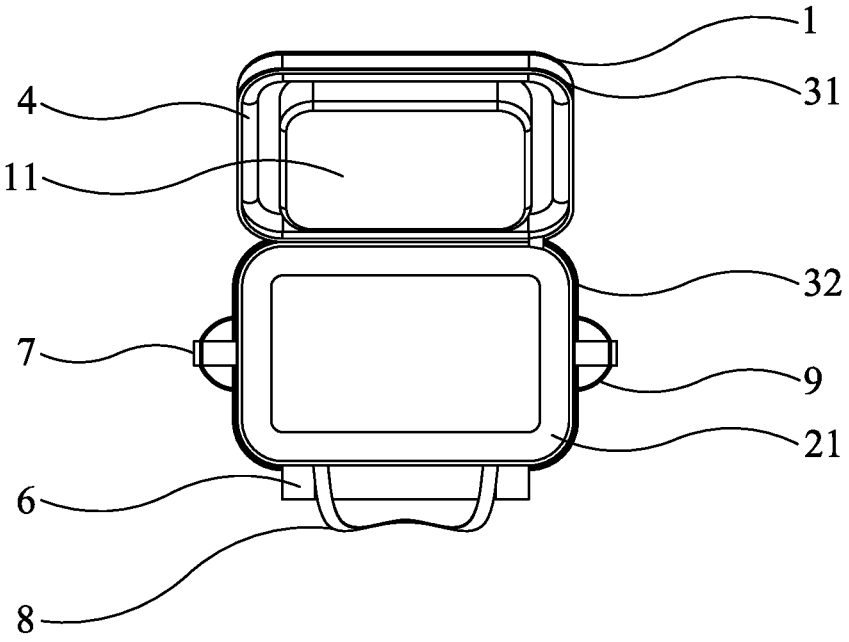
FIG. 5 is a top view of the preferred embodiment of the present invention in an open state.

Embodiments of the present invention will now be described, by way of example only, with reference to the accompanying drawings.

Spatially relative terms, such as "upper," "lower," "left," "right," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures.

As shown in FIG. 1 to FIG. 5, a thermal container in accordance with an embodiment of the present invention comprises a cover 1 and a main body 2. The main body 2 is formed with a storage space. The cover 1 is movably connected to the opening of the main body 2. The cover 1 is opened and closed relative to the main body 2 through an opening-closing assembly 3. In the embodiment, the cover 1 is pivotally connected to the main body 2. The opening-closing assembly 3 includes an upper connecting member 31 and a lower connecting member 32 that cooperate with each other. The upper connecting member 31 is connected to the cover 1, and the lower connecting member 32 is connected to the main body 2. The thermal container may be a thermal box, a thermal bag, or a container in a different shape.

The opening-closing assembly 3 is a zipper. The opening-closing assembly 3 may be magnetic strips that are able to attract each other and disposed at the joint between the cover 1 and the main body 2, or other components capable of engage the cover 1 with the main body 2.

The cover 1 is formed with a sealing protrusion 11 that is located at the inner side of the upper connecting member 31 and extends toward the main body 21. The main body 2 is formed with an annular retaining wall 21 extending from the upper portion of the inner wall of the main body 2. The sealing protrusion 11 is movably fitted to the retaining wall 21. A sealing ring 4 is disposed at the mating portion between the cover 1 and the main body 2. The sealing ring 4 is fixed to the cover 1 or the main body 2, and is movably abutted against the retaining wall 21 or the sealing protrusion 11. When the cover 1 and the main body 2 are in a closed state, the sealing ring 4 blocks the gap between the sealing protrusion 11 and the retaining wall 21, thereby enhancing the airtightness between the sealing protrusion 11 and the retaining wall 21 to prevent air leakage or liquid leakage.

The sealing ring 4 is made of a material having elastic deformation ability, such as polyvinyl chloride (PVC), thermoplastic polyurethane (TPU), thermoplastic rubber (TPR), rubber or silicone.

The cover 1 and the main body 2 are made of fabrics and have a certain shaping ability. An upper shaping board 12 is interlaid between the sealing protrusion 11 and the cover 1. The retaining wall 21 extends downward to the bottom of the main body 2. A side shaping board 22 is interlaid between the retaining wall 21 and the main body 2. The upper shaping board 12 and the side shaping board 22 are configured to increase the shaping ability of the thermal container and maintain the stability of the shape.

The upper shaping board 12 and the side shaping board 22 are made of a foam material having thermal insulation properties, such as PE cotton, ethylene-vinyl acetate (EVA), thermoplastic rubber (TPR) or nitrile butadiene rubber (NBR). The fabrics are made of a composite material of a polyvinyl chloride (PVC), thermoplastic polyurethane (TPU), ethylene-vinyl acetate (EVA) or poly ethylene-vinyl acetate (PEVA) material and a textile material.

Figure 6:
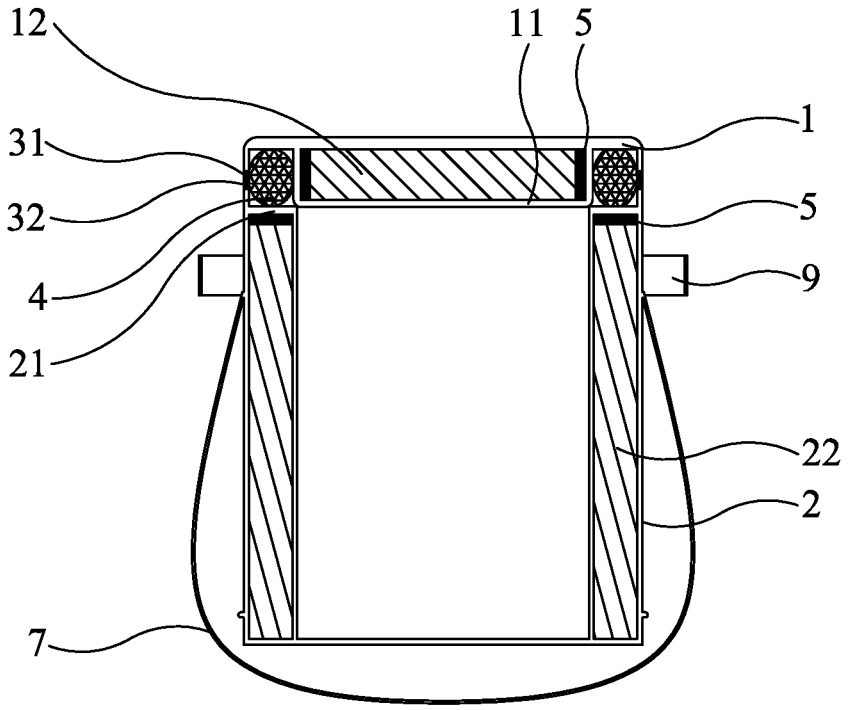
FIG. 6 is a schematic view showing the sealing ring fixed to a first position of the present invention.

As shown in FIG. 6, the sealing ring 4 is disposed between the side surface of the sealing protrusion 11 and the top surface of the retaining wall 21. When the opening-closing assembly 3 is closed, the sealing ring 4 is pressed by the cover 1 and the retaining wall 21 to seal the gap between the sealing protrusion 11 and the retaining wall 21. The sealing ring 4 may be fixed to the cover 1 beside the sealing protrusion 11 or the side surface of the sealing protrusion 11, or may be fixed to the top surface of the retaining wall 21.

Figure 7:
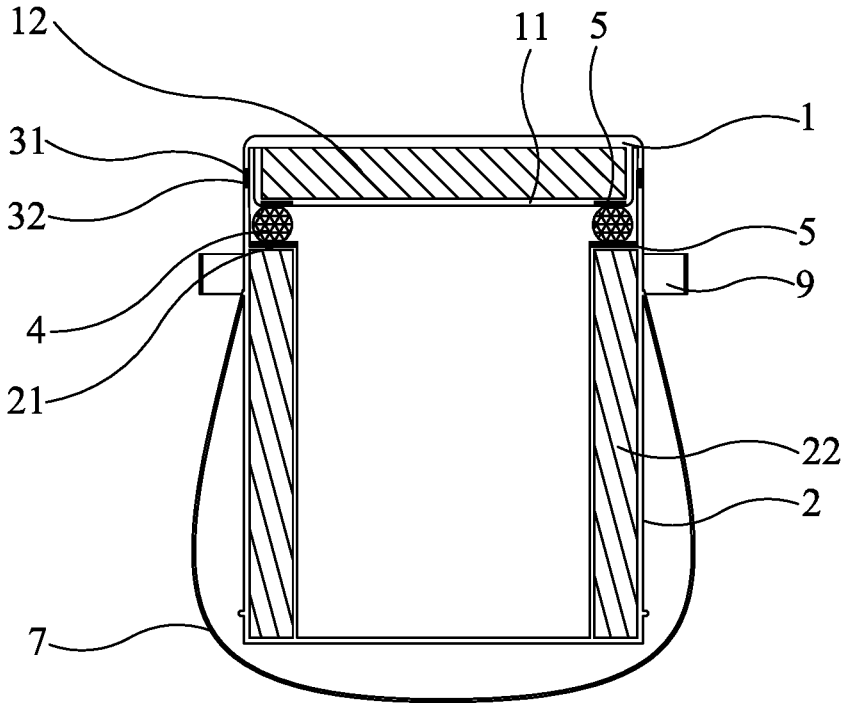
FIG. 7 is a schematic view showing the sealing ring fixed to a second position of the present invention.

As shown in FIG. 7, the sealing ring 4 may be disposed between the underside of the sealing protrusion 11 and the top surface of the retaining wall 21. When the opening-closing assembly 3 is closed, the sealing ring 4 is pressed by the sealing protrusion 11 and the retaining wall 21 to seal the gap between the sealing protrusion 11 and the retaining wall 21. The sealing ring 4 may be fixed to the underside of the sealing protrusion 11, or may be fixed to the top surface of the retaining wall 21.

Figure 8:
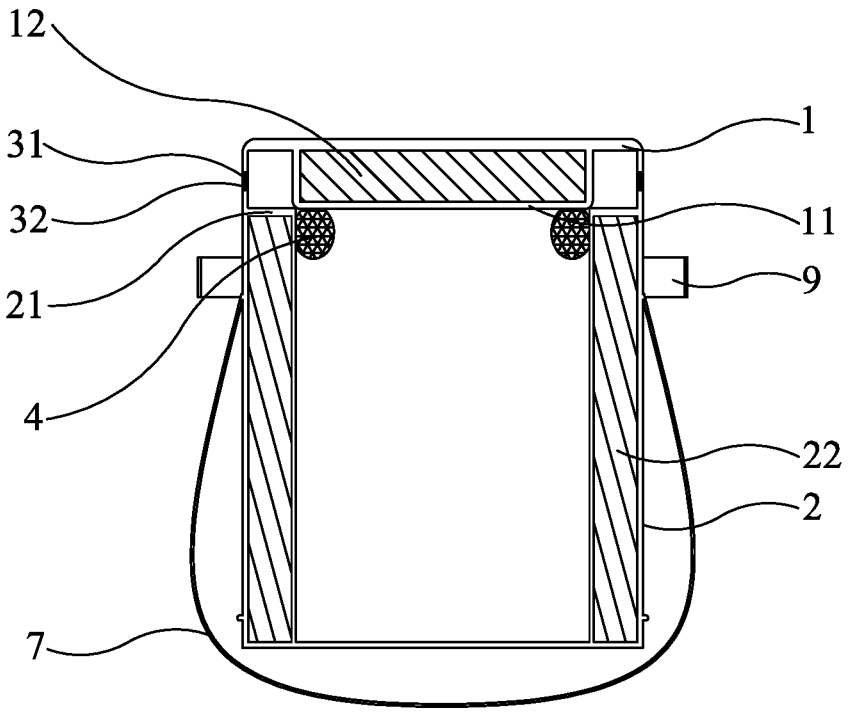
FIG. 8 is a schematic view showing the sealing ring fixed to a third position of the present invention.

As shown in FIG. 8, the sealing ring 4 may be disposed between the underside of the sealing protrusion 11 and the side surface of the retaining wall 21. When the opening-closing assembly 3 is closed, the sealing ring 4 is pressed by the sealing protrusion 11 and the retaining wall 21 to seal the gap between the sealing protrusion 11 and the retaining wall 21. The sealing ring 4 may be fixed to the underside of the sealing protrusion 11. When the sealing ring 4 is not applied with a force, the sealing ring 4 extends out of the side surface of the sealing protrusion 11. The sealing ring 4 may be fixed to the side surface of the retaining wall 21; when the sealing ring 4 is not applied with a force, the sealing ring 4 extends out of the top surface of the retaining wall 21.

Figure 9:
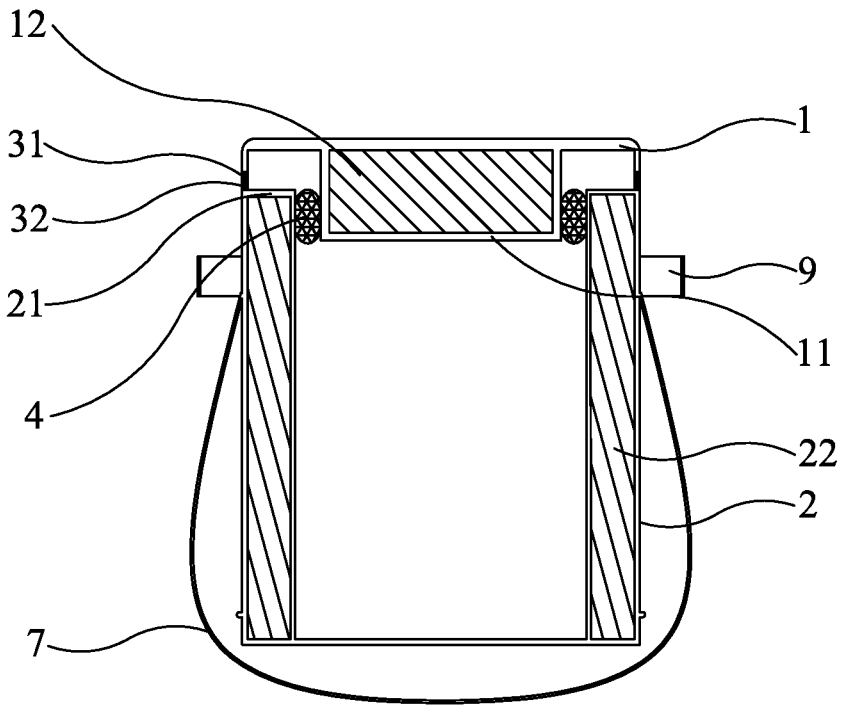
FIG. 9 is a schematic view showing the sealing ring fixed to a fourth position of the present invention.

As shown in FIG. 9, the sealing ring 4 may be disposed between the side surface of the sealing protrusion 11 and the side surface of the retaining wall 21. When the opening-closing assembly 3 is closed, the sealing ring 4 is pressed by the sealing protrusion 11 and the retaining wall 21 to seal the gap between the sealing protrusion 11 and the retaining wall 21. The sealing ring 4 may be fixed to the side surface of the sealing protrusion 11, or may be fixed to the side surface of the retaining wall 21. The sealing ring 4 not only blocks the gap between the sealing protrusion 11 and the retaining wall 21 but also achieves a fastening function, so that the sealing protrusion 11 and the retaining wall 21 are tightly mated with each other, that is, the cover 1 and the main body 2 are tightly mated with each other. The cost of the opening-closing assembly 3 can be saved during production.

As shown in FIG. 6 and FIG. 7, When the cover 1 and the main body 2 are made of fabrics, a support board 5 is provided at the mating portion between the sealing ring 4 and the cover 1 or/and the main body 2 to provide a support force to deform the sealing ring 4. The support board 5 may be made of a plastic material. The support board 5 may be fixed to the surface of the inner layer fabric of the cover 1 or/and the main body 2 by gluing or the like. The support board 5 may be interlaid between the inner layer fabric and the outer layer fabric of the cover 1 or/and the main body 2.

Through the above structure, when the cover 1 is fastened to the main body 2 through the opening-closing assembly 3, the sealing protrusion 11 covers the inner surface of the retaining wall 21 to seal the cover 1 and the main body 2. The sealing ring 4 is pressed to block the gap between the sealing protrusion 11 and the retaining wall 21, thereby increasing the airtightness between the sealing protrusion 11 and the retaining wall 21 to prevent air leakage or liquid leakage from the gap of the opening-closing assembly 3. The thermal insulation property of the thermal container is improved.

The outside of the main body 2 is provided with a storage bag 6 for storing small items.

The outside of the main body 2 is provided with a shoulder strap 7. Two ends of the shoulder strap 7 are connected to opposite sides of the main body 2, respectively. For carrying the thermal container conveniently, the two ends of the shoulder strap 7 are connected to the narrow sides of the main body 2, respectively. For moving or carrying the thermal container, the user can shoulder the main body 2 through the shoulder strap 7 across the user's shoulder. The length of the shoulder strap 7 is adjustable, which is suitable for people of different heights.

The outside of the main body 2 is provided with two hand straps 8 that are disposed symmetrically on opposite sides of the main body 2. For moving or carrying the thermal container, the user can lift the main body 2 through the hand straps 8 for a short-distance movement.

The outside of the main body 2 is provided with two handles 9 that are disposed symmetrically on opposite sides of the main body 2. For moving or carrying the main body 2 stored with heavy articles, the handles 9 on both sides of the main body 2 can be lifted by two people to move the main body 2 together.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A thermal container, comprising a cover and a main body, the main body being formed with a storage space, the cover being movably connected to an opening of the main body, the cover being opened and closed relative to the main body through an opening-closing assembly; the opening-closing assembly including an upper connecting member and a lower connecting member that cooperate with each other, the upper connecting member being connected to the cover, the lower connecting member being connected to the main body; the cover being formed with a sealing protrusion that is located at an inner side of the upper connecting member and extends toward the main body, the main body being formed with an annular retaining wall extending from an upper portion of an inner wall of the main body, the sealing protrusion being movably fitted to the retaining wall; a sealing ring being provided at a mating portion between the cover and the main body, the sealing ring being fixed to one of the cover and the main body, wherein the sealing ring is made of an elastically deformable material and selectively compresses against the retaining wall and the sealing protrusion to effect sealing between the cover and the main body;

wherein the annular retaining wall of the main body comprises a top surface and a circumferential surface extending from the top surface to a bottom of the main body; and the sealing ring is located between the circumferential surface of the annular retaining wall of the main body and a predetermined surface of the sealing protrusion of the cover;

wherein the cover and the main body are made of fabrics; an upper shaping board is interlaid between the sealing protrusion and the cover; the retaining wall extends downward to the bottom of the main body, and a side shaping board is interlaid between the retaining wall and the main body;

wherein a support board is provided at a mating portion between the sealing ring and the cover or/and the main body.

2. The thermal container as claimed in claim 1, wherein the predetermined surface of the sealing protrusion of the cover comprises a circumferential surface of the sealing protrusion and the sealing ring is disposed between the circumferential surface of the sealing protrusion and the circumferential surface of the retaining wall.

3. The thermal container as claimed in claim 1, wherein the fabrics are made of a composite material comprising a textile material and one of a polyvinyl chloride (PVC), thermoplastic polyurethane (TPU), ethylene-vinyl acetate (EVA) and poly ethylene-vinyl acetate (PEVA) material.

4. The thermal container as claimed in claim 1, wherein the upper shaping board and the side shaping board are made of PE cotton, ethylene-vinyl acetate (EVA), thermoplastic rubber (TPR) or nitrile butadiene rubber (NBR).

5. The thermal container as claimed in claim 1, wherein the support board is made of a plastic material.

6. The thermal container as claimed in claim 5, wherein the support board is fixed to a surface of an inner layer fabric of the main body or/and the cover.

7. The thermal container as claimed in claim 5, wherein the support board is interlaid between an inner layer fabric and an outer layer fabric of the main body or/and the cover.

8. The thermal container as claimed in claim 1, wherein the sealing ring is made of polyvinyl chloride (PVC), thermoplastic polyurethane (TPU), thermoplastic rubber (TPR), rubber or silicone.

9. The thermal container as claimed in claim 1, wherein the opening-closing assembly is a zipper.

* * * * *